United States Patent [19]

Harada

[11] Patent Number: 5,017,031

[45] Date of Patent: May 21, 1991

[54] PRINTING APPARATUS HAVING AN AUTOMATIC PAPER INSERTION FUNCTION

[75] Inventor: Yuichi Harada, Nagoya, Japan

[73] Assignee: Brother Kogyo Kabushiki Kaisha, Aichi, Japan

[21] Appl. No.: 513,061

[22] Filed: Apr. 23, 1990

[30] Foreign Application Priority Data

Jul. 8, 1989 [JP] Japan ..... 1-176378

[51] Int. Cl.[5] ..... B41J 13/36; B41J 13/20

[52] U.S. Cl. ..... 400/636.1; 400/550; 400/639.1; 400/712

[58] Field of Search ..... 400/54, 320, 322, 636, 400/636.1, 639.1, 639.2, 637.1, 708, 712, 582, 550, 551

[56] References Cited

U.S. PATENT DOCUMENTS

| | | | |
|---|---|---|---|
| 4,273,456 | 6/1981 | Bisczat et al. | 400/639.1 |
| 4,647,239 | 3/1987 | Maezawa et al. | 400/639.1 |
| 4,685,815 | 8/1987 | Baranyl | 400/54 |
| 4,693,621 | 9/1987 | Kawaguchi | 400/636.1 |
| 4,702,632 | 10/1987 | Taketani | 400/639.1 |
| 4,707,159 | 11/1987 | Hirano et al. | 400/639.1 |
| 4,714,364 | 12/1987 | Takada | 400/639.1 |
| 4,832,519 | 5/1989 | Fujimoto | 400/639.1 |
| 4,961,658 | 10/1990 | Takagi | 400/636.1 |

FOREIGN PATENT DOCUMENTS

| | | | |
|---|---|---|---|
| 0166476 | 8/1985 | Japan | 400/639.1 |
| 0005873 | 1/1987 | Japan | 400/54 |
| 0158071 | 7/1987 | Japan | 400/54 |
| 0208970 | 9/1987 | Japan | 400/639.1 |
| 0249779 | 10/1987 | Japan | 400/54 |
| 0071377 | 3/1988 | Japan | 400/54 |

*Primary Examiner*—Eugene H. Eickholt

*Attorney, Agent, or Firm*—Oliff & Berridge

[57] ABSTRACT

A printing apparatus includes one detection switch which is operated according to the movements of a carriage and a paper bail unit. The detection signal outputted from the detection switch is used for a control to locate the carriage to an origin position thereof and a control for automatic paper supply. A CPU judges by which one of the carriage and the paper bail unit the detection switch is operated.

10 Claims, 7 Drawing Sheets

PRINTING APPARATUS HAVING AN AUTOMATIC PAPER INSERTION FUNCTION

BACKGROUND OF THE INVENTION

1. Field of the Invention

The present invention relates to a printing apparatus and, more particularly, to a printing apparatus in which a detection switch for setting an origin of a carriage is commonly used as a switch for starting automatic paper supply.

2. Description of the Prior Art

In an electronic typewriter, a printing operation for a printing paper held by a platen roller is executed while a carriage mounted with a printing mechanism moves along the platen roller. In an ordinary typewriter, a paper holding roller called a paper bail roller is provided for preventing the printing paper from floating up from the platen roller in printing operation. The paper bail roller can be moved to a pressed position, in which the paper bail roller is pressed against the platen roller, and to a released position, in which the paper bail roller is released from the platen roller, and in printing operation it is located at the pressed position. When the printing paper is inserted, the paper bail is located in the released position until the tip of the printing paper passes between the platen roller and the paper bail roller to make the insertion operation be performed securely.

There is well known technology in which the insertion operation of the printing paper is performed utilizing the operator's action of releasing the paper bail as a trigger; the technology is shown, for example, in a printing device disclosed in U.S. Pat. No. 4,498,795, in which attention is paid to the fact that the paper bail roller is released as mentioned in the above when the printing paper is inserted.

In an ordinary electronic typewriter, control for setting the origin position of a carriage is executed when power supply is switched on or when the cover of the printing mechanism is closed after a character wheel or the like is exchanged.

In an electronic typewriter in which paper supply operation is performed utilizing the releasing action of the paper bail roller as a trigger, a detection switch for setting the origin position of the carriage and another detection switch for detecting the operation of a paper bail arm for supporting the paper bail roller are separately provided to be used exclusively for each purpose. These detection switches are connected to different input ports of an input interface in a control device. The control device judges which detection switch the detection signal is from and, according to the detection signal, it executes origin setting control or automatic paper supply control.

In a conventional electronic typewriter in which automatic paper supply is possible, as mentioned in the above, a switch for setting the origin of the carriage and a switch for automatic paper supply are separately provided and these switches are connected to different input ports, so that there can be the following problems: the number of parts is increased; the same number of input ports as that of the switches is needed; and in some case an extra port chip is needed for only one port.

SUMMARY OF THE INVENTION

Therefore, it is an object of the present invention to provide a printing apparatus in which necessary numbers of ports and switches for the detection of the origin of a carriage and for automatic paper supply can be reduced.

A printing apparatus according to the present invention comprises: a platen; a carriage movable on a movement path along said platen; carriage driving means for driving said carriage; paper feed means for feeding a printing sheet by the rotation of said platen; a paper bail unit movable between a pressed position being abutted on said platen and a released position being released from said platen; a detection switch for outputting a detection signal, said detection switch outputting said detection signal in response to an occurrence of a first condition in which said carriage reaches a certain position on said movement path and in response to an occurrence of a second condition in which said paper bail unit is moved to said released position; origin setting control means for locating said carriage at an origin position of said carriage on said movement path based on said detection signal; judgment means for judging to which of said first condition and said second condition said detection signal was responsive; stop control means for stopping said origin setting operation when it is judged by said judgment means that said detection signal is outputted responsive to said second condition while said origin setting operation is being executed; and paper feed control means for controlling said paper feed means to feed said printing paper by a predetermined stroke when it is judged by said judgment means that said detection signal is outputted responsive to said second condition while said origin setting operation is not being executed.

In a printing apparatus according to the present invention, the origin setting control means drives the carriage through the carriage driving means and performs the setting of the carriage origin on the basis of the signal from the detection switch when it is operated by the carriage. But, when the judgment means judges that the detection switch is operated by the paper bail unit, the origin setting of the carriage cannot be performed so that the origin setting control is stopped by the stop control means. During the period from the time of completion of the origin setting control until the next origin setting command is inputted, the detection switch is not operated by the carriage, and when the paper bail unit is moved to the released position and the detection switch is thus operated by the paper bail unit, the printing paper feed control means transfers the printing paper by a predetermined stroke.

BRIEF DESCRIPTION OF THE DRAWINGS

The above and other objects, features and advantages of the present invention will become more apparent from reading the following description of the preferred embodiment taken in connection with the accompanying drawings, in which.

DETAILED DESCRIPTION OF THE PREFERRED EMBODIMENT

The present embodiment is an example of a case where the present invention is applied to an electronic typewriter in which automatic paper supply is possible. The terms expressing positions such as right, left, etc. in the following explanation express the positions when the electronic typewriter shown in FIG. 1 is seen from the front, namely, from the right side in FIG. 1.

Figure 1:
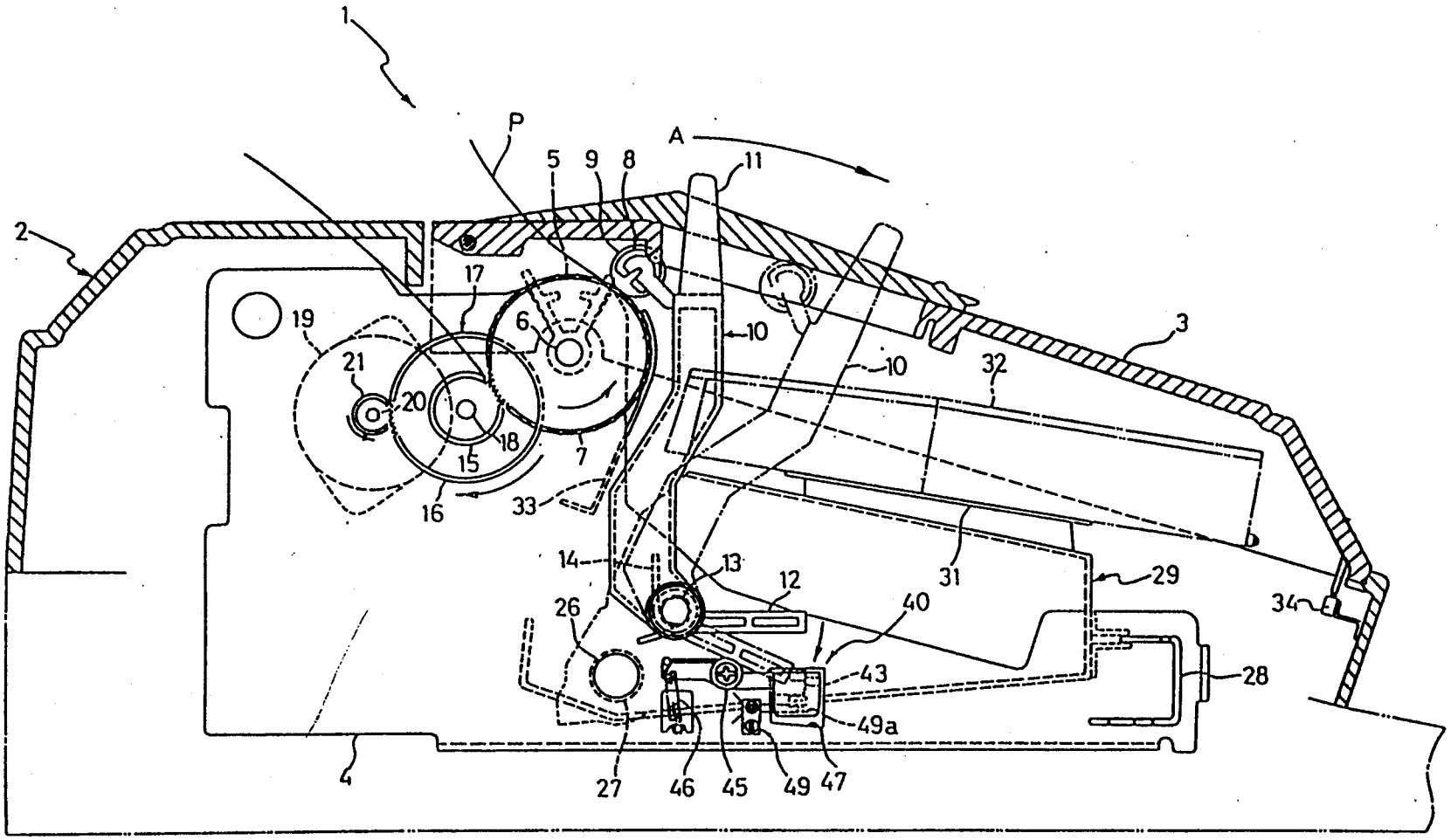
FIG. 1 is a side view showing the internal mechanism of a typewriter according to an embodiment of the present invention.

As shown in the left side part of the internal mechanism shown in FIG. 1, side wall panels 4 are provided on both sides of a main body frame 2 of the typewriter 1. A platen 5 disposed between a couple of the side wall panels 4 is rotatably held with the side wall panels 4 in the vicinities of both end parts of the platen shaft 6. A passive gear 7 and a platen knob (not shown in the drawing) are fixed on the left end of the platen shaft 6.

A paper bail 8 is disposed in parallel to the platen 5, and paper bail arms 10 which extend downward from both ends of the paper bail 8 are formed in a unity. The lower ends of the paper bail arms 10 are pivotally supported on pins 13 fixed on the side wall panels 4. Torsion springs 14 are fixed on the pins 13. One end of the spring 14 is engaged with the paper bail arm 10 at its engaged part, and the other end is engaged with the side wall panel 4. When a handling part 11 provided on the upper end of the left paper bail arm 10 is moved forward (in the direction of an arrow A), the paper bail 8 is switched to a released position (shown by a two-dot-chain line) being released from the platen 5 and when the movement operation by the handling part 11 is stopped, the paper bail 8 is switched back to a pressed position (shown by a solid line) in which it is abutted on the platen 5 by the force of the torsion springs 14 through the paper bail arms 10. A plurality of pressing rollers 9 are rotatably provided on the paper bail 8. The paper bail 8 is arranged to press a printing paper P, supplied to the platen 5, against the platen 5 through the pressing rollers 9.

In the rear of the passive gear 7, an intermediate gear 17 comprising a small diameter gear 15 and a large diameter gear 16 having a larger diameter than that of the gear 15 is pivotally held with a pin 18 fixed on the side wall panel 4. The passive gear 7 is engaged with the small diameter gear 15. In the rear of the intermediate gear 17 a line feed motor 19 is mounted on the side wall panel 4 to be adjustable in position. A driving gear 21 fixed on a driving shaft 20 of the line feed motor 19 is engaged with the large diameter gear 16 of the intermediate gear 17.

When a return key, a preline key, etc. provided on a keyboard 25 is operated, the line feed motor 19 is driven by a control device C (refer to FIG. 4) and the passive gear 7 is driven through the driving gear 21 and the intermediate gear 17, and the platen 5 is rotated to feed the printing paper P by a predetermined distance.

Figure 3:
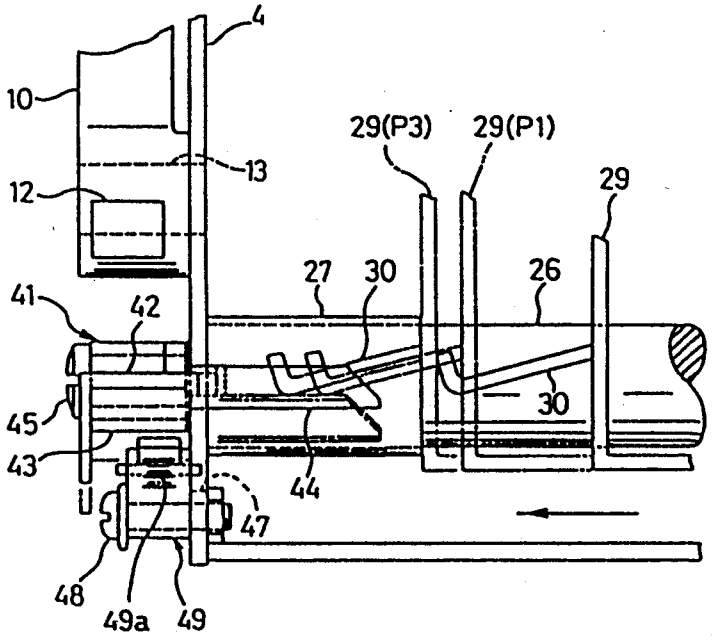
FIG. 3 is an enlarged front view of essential parts of the internal mechanism.

A guide rod 26 and a guide member 28 are supported by both side wall panels 4. A carriage 29 is movably supported on its rear end lower part and its front end by the guide rod 26 and the guide member 28, respectively, and is driven to be laterally moved by a carriage driving motor 55 (refer to FIG. 4) which is controlled by the control device C. A character wheel (not shown in the drawing), a ribbon cassette 32, etc., which may constitute a well known printing mechanism, are mounted on a holder member 31 in the upper part of the carriage 29. A paper meter 33 provided along the front surface of the platen 5 is fixed on the rear part of the carriage 29. A sleeve 27 having a specific length in a horizontal direction as shown in FIG. 3 is fixed on the left end of the guide rod 26. The movement limiting position P3 toward the left of the carriage 29 is defined by the abutment of the carriage 29 against the right end of the sleeve 27. A cover switch 34 for detecting the open/close condition of a cover 3 is fixed on the front end wall of the main body frame 2.

Figure 2:
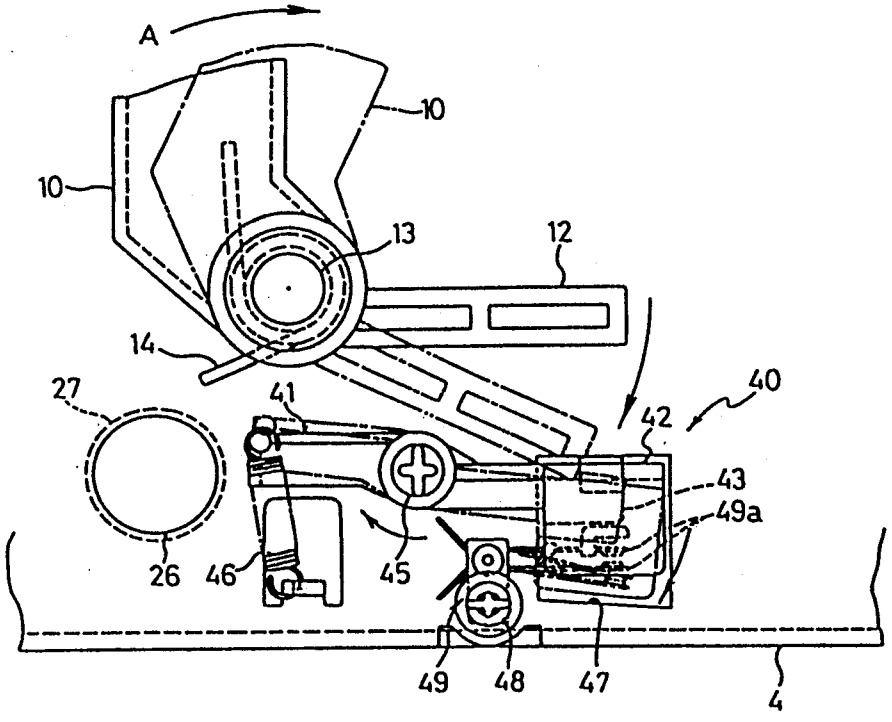
FIG. 2 is an enlarged side view of essential parts of the internal mechanism.

Following is an explanation of the switching operation of the paper bail arms 10 and operation control mechanism 40 which operates a detection switch 49 according to the movement of the carriage 29 into the vicinity of the movement limiting position on the left side referring to FIG. 1 to FIG. 3.

On the lower end of the paper bail arm 10 on the left side, an operation member 12 is formed in a unity which extends forward. An origin link 41 which extends forward and rearward is disposed just under the operation member 12, and the origin link 41 is turnably supported on the side wall panel 4 with a stepped screw 45 at its approximately central part. The rear end of the origin link is elastically urged downward by a tension spring 46, and the origin link 41 is always held substantially horizontally by the engagement of the upper surface of an opening 47 of the side wall panel 4 with an operating piece 44 to be explained later. On the front end of an operation arm 42 at the front half part of the origin link 41, an operation unit 43 is formed for operating a contact piece 49*a* of a pair of spring contacts of the detection switch 49. Switch 49 is fixed on the side wall panel 4 with screw 48 at a place just under the operation arm 42, and on the right end of the operation unit 43 is integrally formed the operating piece 44 which extends rightward through the opening 47 on the side wall panel 4. The right end of the operating piece 44 forms a sloped cam surface.

Next, an explanation of the operation of the operation control mechanism 40 will be given.

When the operation part 11 of the left paper bail arm 10 is operated forward (in the direction of the arrow A) for automatic paper supply, the operation member 12 is turned clockwise (refer to FIG. 2) and the origin link 41 is turned clockwise against the force of the tension spring 46 by depressing the operation arm 42 of the origin link 41 from the upper side with the front end of the operation member 12. In this operation, two contact pieces 49*a* are brought into contact by the operation unit 43 so that the detection switch 49 is closed.

When the carriage 29 is moved to a switch operation position P1 near the movement limiting position P3 on the left side on the basis of an origin setting command signal as shown in FIG. 3, the origin link 41 is turned clockwise (refer to FIG. 2) against the force of the tension spring 46 by depressing the operating piece 44 downward with an operation member 30 fixed on the left end of the carriage 29. Thereby, in the same way as described above, the detection switch 49 is closed.

Figure 4:
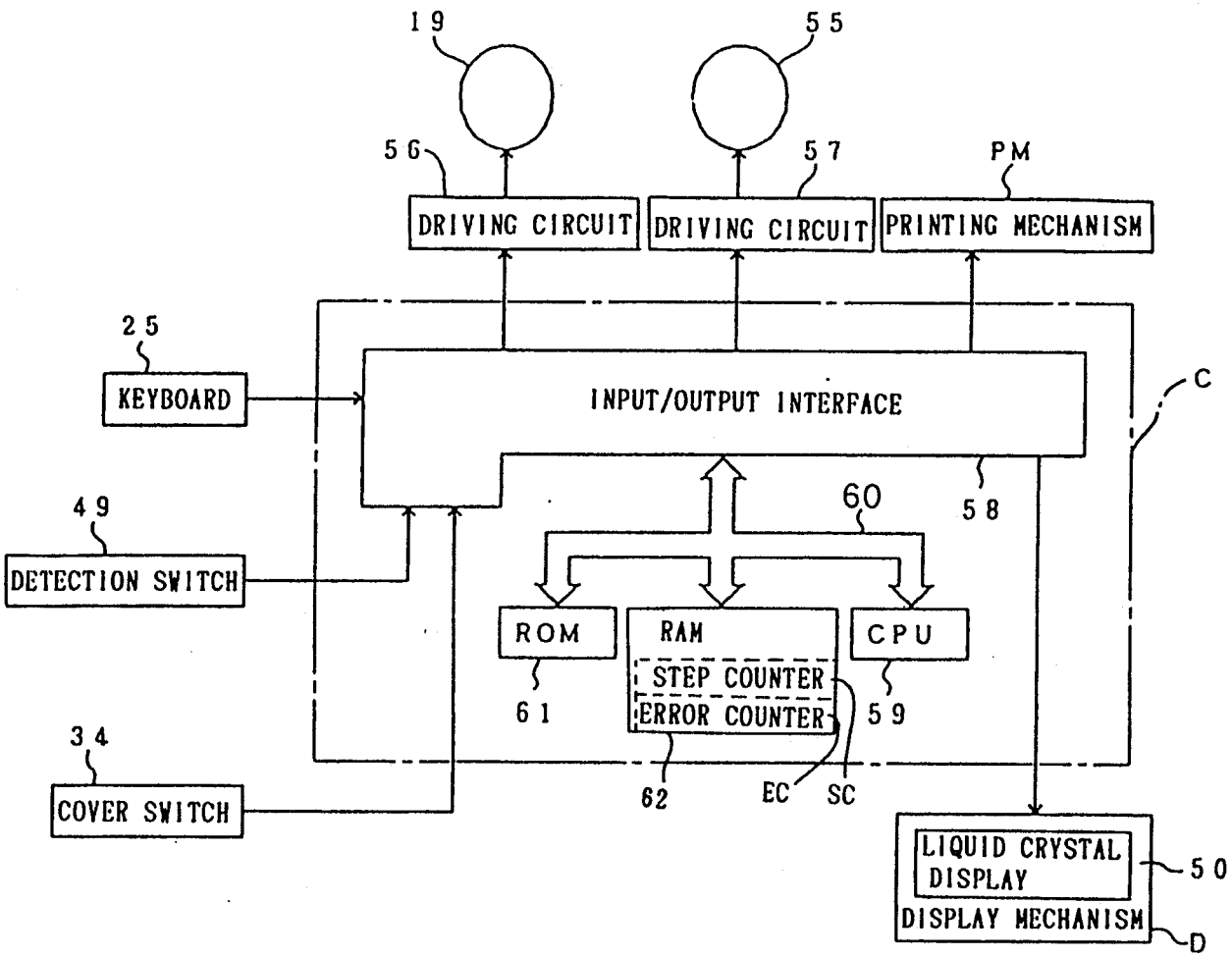
FIG. 4 is a block diagram of a typewriter control system.

Next, the explanation for the whole constitution of the control system of the electronic typewriter 1 will be given based on the block diagram shown in FIG. 4.

A printing mechanism PM may be a similar one to the printing mechanism of an ordinary electronic typewriter, so that an explanation thereof is omitted. A display mechanism D may also be a conventional one comprising a liquid crystal display 50, provided just behind the keyboard 25, and a display controller.

Driving circuits 56 and 57 are respectively connected to the line feed motor 19 and the carriage driving motor 55. The keyboard 25, the detection switch 49, the cover switch 34, the driving circuits 56 and 57, the printing mechanism PM and the display mechanism D are respectively connected to an input/output interface 58 of a control device C.

The control device C comprises a CPU 59, the input-/output interface 58 connected to the CPU 59 through buses 60 such as a data bus, a ROM 61 and a RAM 62.

Control programs for controlling driving circuits for the printing mechanism PM, the driving circuits 56 and 57, and the display mechanism D are stored in the ROM 61. Also, control programs for the carriage origin setting control and the automatic paper feed control are stored in the ROM 61.

A step counter SC for counting the number of driving steps of the carriage driving motor 55 (counting value equal I), an error counter EC for counting the number of times of errors during the operation of the origin setting control (counting value equal J), and memories for temporarily storing the operation results operated by the CPU 59 are provided in the RAM 62.

Figure 5A:
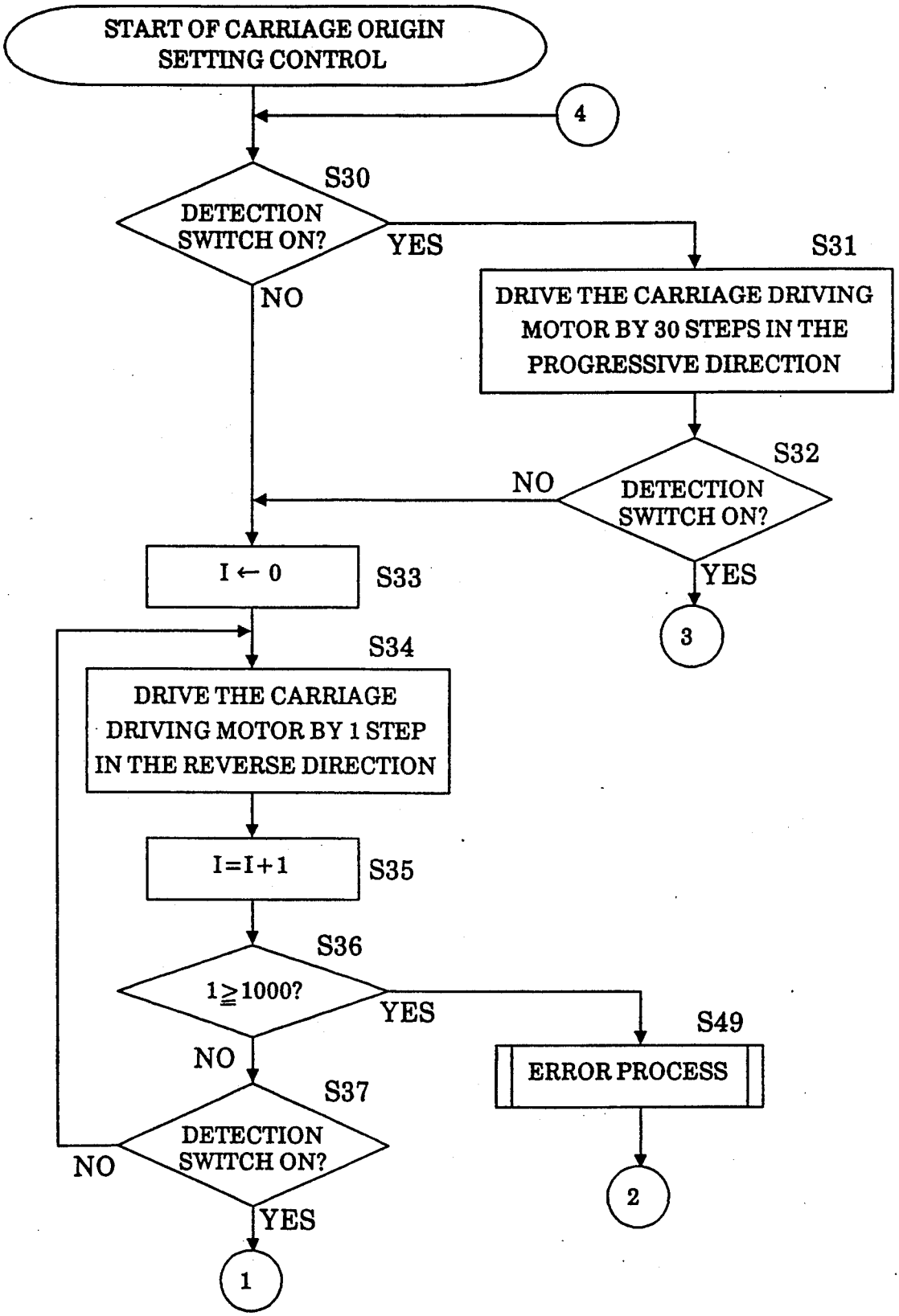
FIG. 5 is a flow chart of a control routine for carriage origin setting.
Figure 5:
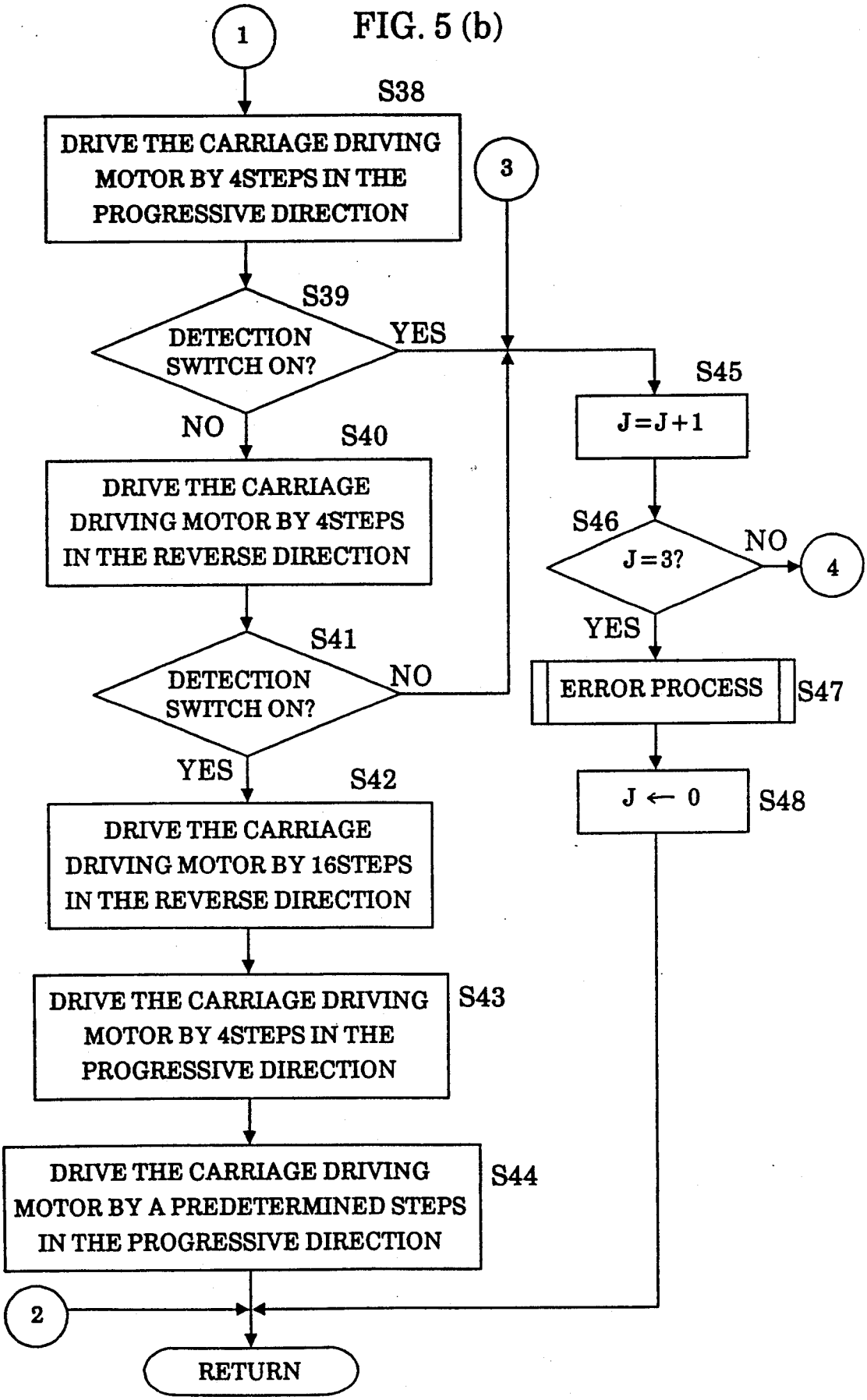
Figure 6:
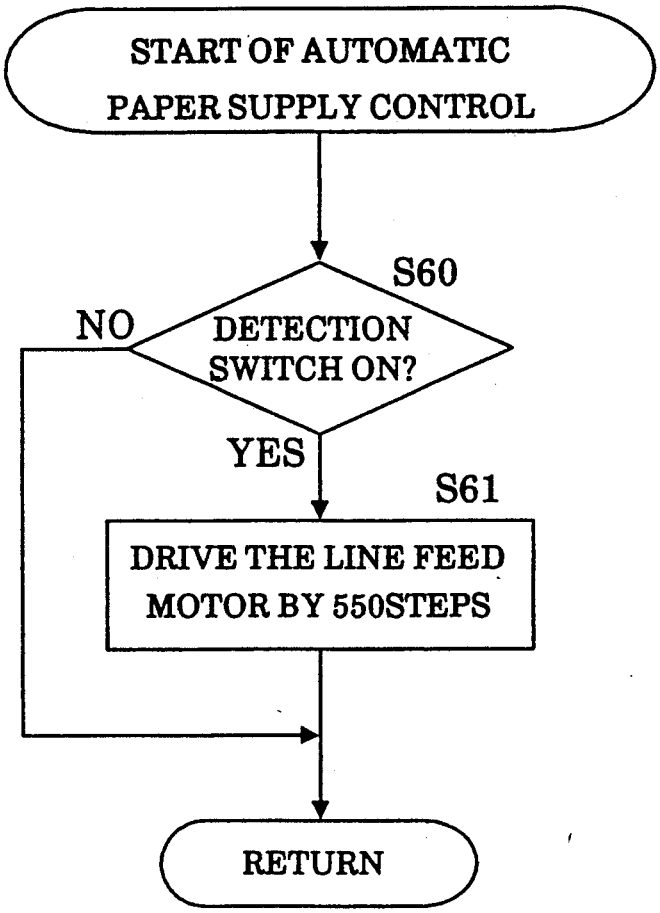
FIG. 6 is a flow chart of a control routine for automatic paper supply.
Figure 7:
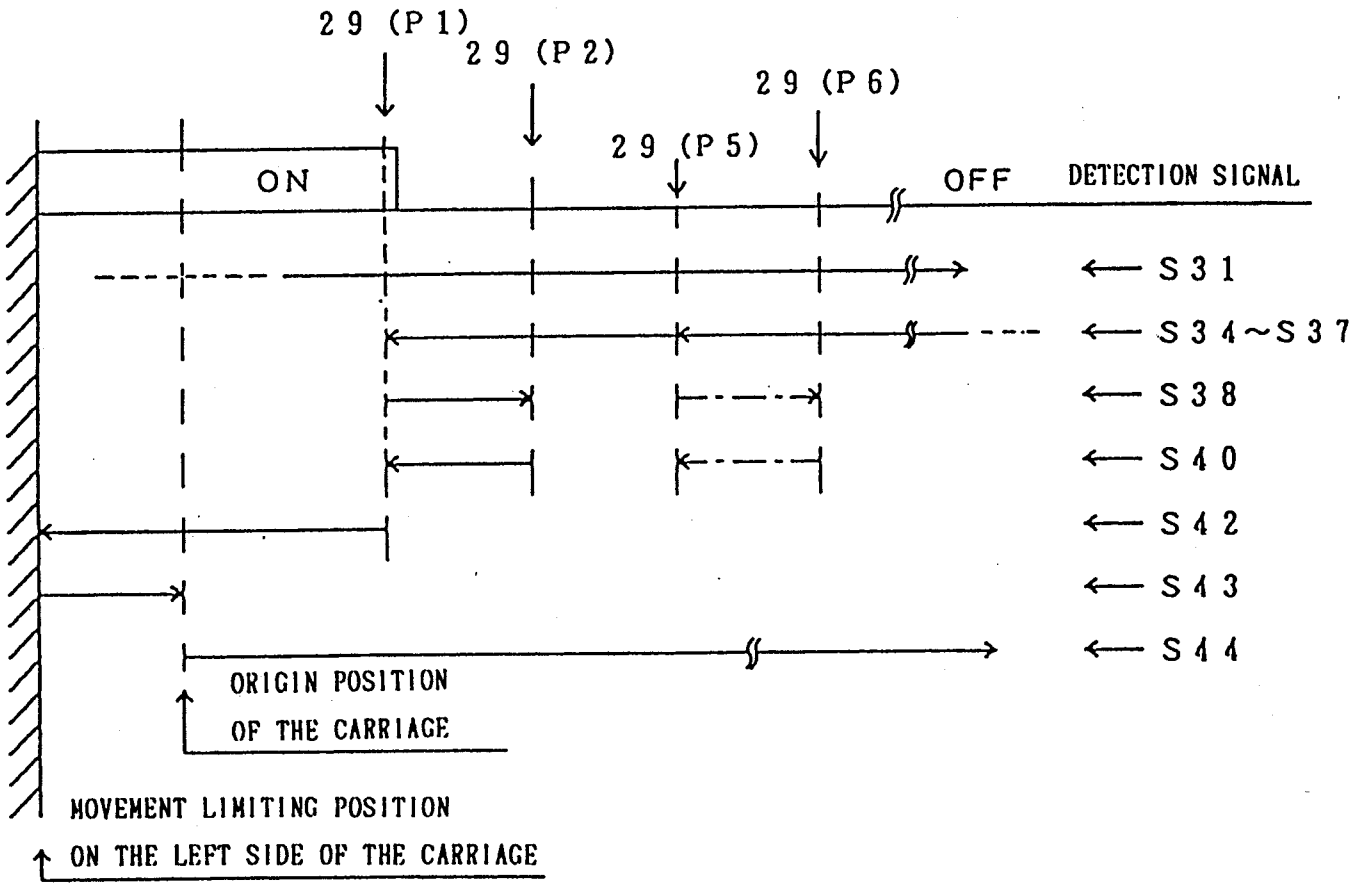
FIG. 7 is an illustrative representation when the origin position of the carriage is set.

An explanation of the routines of the carriage origin setting control and the automatic paper feed control to be executed by the control device C of the electronic typewriter 1 will be given based on the flow charts in FIG. 5 and FIG. 6, and the illustrative representation of operation in FIG. 7. Both control processes shown in FIG. 5 and FIG. 6 are executed as interruption handling when the main routine is being executed. The symbols S31, S34 and so on written in the right end part in FIG. 7 correspond respectively to the symbols S31, S34 and so on expressing the steps in the flow chart shown in FIG. 5.

When power is supplied to the typewriter 1 or when the cover 3 is opened and closed and accordingly the cover switch 34 is opened and closed, the carriage origin setting control, shown in FIG. 5, is started by the origin setting command signal outputted from the control program. At first, a switch signal of the detection switch 49 is read and the signal is judged if it is ON or OFF by the CPU 59 (S30). When the detection switch 49 is OFF, steps S33 to S37 are executed, namely, the carriage driving motor 55 is driven in reverse direction step by step (in the direction opposite to that when the carriage 29 is moved in printing operation) at S34 and the counting value I of the step counter SC is incremented (S35) and it is judged whether the detection switch 49 is ON or OFF. The judgment at S36 is described afterward. As shown in FIG. 3 and FIG. 7, when the carriage 29 reaches the switch operation position P1 and the operation member 30 depresses the operating piece 44 downward to turn the detection switch 49 ON, the judgment at S37 becomes YES. Then, steps S38 to S41 are executed and it is judged whether or not the ON condition of the detection switch 49 is caused by the movement of the carriage 29. Namely, the carriage 29 is moved by 4 steps in the progressive direction (the direction in which the carriage 29 is moved in printing operation) from the switch operation position P1 to a confirmation position P2, for the confirmation of the OFF state of the detection switch 49 (S38 and S39). Further, the carriage 29 is moved from the confirmation position P2 to the switch operation position P1 by 4 steps in the reverse direction for the confirmation of the 0N state of the detection switch 49 (S40 and S41). Where the origin detection of the carriage 29 is normally performed, the judgment in S41 becomes YES. Next, the carriage driving motor 55 is driven by 16 steps in the reverse direction (S42). The number of steps necessary to move the carriage 29 from the switch operation position P1 to the movement limiting position P3 is set to be less than 16, so that in step S42 the carriage driving motor 55 is stepped out because the movement of the carriage 29 is limited at the movement limiting position P3 abutting on the sleeve 27. After that, the carriage driving motor 55 is driven by 4 steps in the progressive direction for setting the origin position P4 of the carriage 29. Then, the carriage driving motor 55 is rotatingly driven in the progressive direction to move the carriage 29 outside the switch activated area to a predetermined position (for example, a left margin position or a starting position for printing) (S44). The normal origin detection operation of the carriage 29 can be completed by the series of processes as described in the above.

When the control for detecting the origin of the carriage 29 is started as shown in FIG. 5, if the detection switch 49 is in the ON state, the following cases can be considered: a case where the carriage 29 is in the switch activated area when the control is started, i.e., the area which is on the left side of the switch operation position P1, or a case where the handling part 11 of the paper bail arm 10 is operated by an operator to be in the released position. Therefore, when the judgment in S30 is YES, the carriage driving motor 55 is preferably driven by 30 steps in the progressive direction in S31. As described in the above, the number of steps necessary to move the carriage 29 between the switch operation position P1 and the movement limiting position P3 is less than 16, so that when the detection switch 49 is turned ON by the fact that the carriage 29 is positioned in the switch activated area, the carriage 29 is moved out of the switch activated area in S31 so that the detection switch 49 is turned OFF. In this case, the judgment in S32 becomes NO and the processes following S33 are executed.

After the process S31, if the judgment in S32 is YES, the operation of the detection switch 49 is caused by the operation of the paper bail arm 10, and so an error judgment process (described below) following the process S45 is executed. During the execution of processes S34 to S37, that is, during the movement of the carriage 29 in the reverse direction, for example, when the carriage 29 is at a position P5 in the movement as shown in FIG. 7, if an operator operates the handling part 11 of the paper bail arm 10 in the direction of the arrow A in FIG. 1, the judgment in S37 is changed to be YES by the operation. After that, S38 is executed and when the carriage 29 comes to a position P6 in the movement, if the judgment is YES in S39, the error judgment process following S45 is executed. Namely, the counting value J of the error counter EC is incremented (S45) and when the counting value J is less than 2 (S46), the processes following S30 are again executed. During the execution of S34 to S37, for example, when the carriage 29 is in the position P5 in the movement, if an operator operates the paper bail arm 109 and during the execution of S38 if he stops the operation of the paper bail arm 10 in good timing, S39 to S40 are executed as in the normal case, but NO is given in the judgment in S41, and after S45, the error judgment process is executed.

When the number of errors reaches a predetermined number, e.g., 3, it is determined that the origin position of the carriage 29 cannot be set due to a prolonged operation of paper bail arm 10. Accordingly, an error process such as sounding a buzzer, a display of a warning, e.g., "do not operate the lever" is executed, the control is stopped (S47), the counting value J of errors is cleared (S48) and the process returns to the start. Although not shown in FIG. 5, counting value J may also be initialized at each start of origin setting control.

A judgment in S32 of YES indicates that an operator is operating the paper bail arm 10 just after the starting of the origin setting control. Therefore the error judgment process following S45 as mentioned in the above is executed in the same way. When it is judged at S36 that the carriage driving motor 55 is driven by 1,000 steps which exceeds the number of steps corresponding to the distance between the movement limiting positions on both sides of the carriage 29, it is an error in the driving system for the carriage 29 including the carriage driving motor 55, so that an error process such as sounding a buzzer is executed and the control is stopped at S49 and the process returns to the start.

After the carriage origin setting control is normally finished, automatic paper supply control may be executed. At such time when an operator operates the paper bail arm 10 to locate the paper bail in the released position and the detection switch 49 is turned ON (S60) by the operation, as there is no probability that the carriage 29 turns the detection switch 49 0N (since the carriage is outside the switch activated area), the automatic paper supply control is started and the line feed motor 19 is rotatingly driven by the quantity corresponding to 550 steps (S61), and the printing paper is supplied to the platen 5 by predetermined strokes, and the process returns to the start.

As described in the above, the detection switch 49 provided for the origin setting of the carriage 29 is commonly used for the detection switch for starting the automatic paper supply. Furthermore, the origin setting control and the automatic paper supply can be independently and securely executed, so that the number of switches for the automatic paper supply can be reduced and also the number of the ports for the input/output interface 58 for the switches can be reduced.

In place of the detection switch 49, other detection switches such as a photointerrupter may be used.

Of course, the present invention can be applied to an electronic typewriter which is so constituted that the origin position of the carriage 29 can be set with the origin setting control without accompanying the stepping-out of the carriage driving motor 55.

What is claimed is:

1. A printing apparatus comprising:

a platen;

a carriage movable on a movement path along said platen;

carriage driving means for driving said carriage;

paper feed means for feeding a printing sheet by the rotation of said platen;

a paper bail unit movable between a pressed position being abutted on said platen and a released position being released from said platen;

a detection switch for outputting a detection signal, said detection switch outputting said detection signal in response to an occurrence of a first condition in which said carriage reaches a certain position on said movement path, and in response to an occurrence of a second condition in which said paper bail unit is moved to said released position;

origin setting control means for locating said carriage at an origin position of said carriage on said movement path based on said detection signal;

judgment means for judging to which of said first condition and said second condition said detection signal was responsive;

stop control means for stopping said origin setting operation when it is judged by said judgment means that said detection signal is outputted responsive to said second condition while said origin setting operation is being executed; and paper feed control means for controlling said paper feed means to feed said printing paper by a predetermined stroke when it is judged by said judgment means that said detection signal is outputted responsive to said second condition while said origin setting operation is not being executed.

2. A printing apparatus according to claim 1, wherein said judgment means executes a first operation in which said carriage is moved in a direction away from a detection switch activated area on said movement path by a predetermined distance necessary to take said carriage out of said area, and a second operation in which said carriage is moved in a direction toward said area by said predetermined distance, and wherein said judgment means determines the occurrence of said first condition when said detection signal is not outputted as a result of said first operation and is outputted as the result of said second operation.

3. A printing apparatus according to claim 2, wherein said judgment means determines the occurrence of said second condition when said detection signal is outputted as a result of said first operation and said second operation.

4. A printing apparatus according to claim 1, further comprising a movable member for activating said detection switch, said movable member being moved to activate said detection switch by said carriage when said carriage reaches said certain position and by said paper bail unit when said paper bail unit is moved to said released position.

5. A printing apparatus according to claim 4, wherein the movement directions of said carriage and said paper bail unit are orthogonal, and wherein said movable member includes a movement translating mechanism for translating the movements of said carriage and said paper bail unit into movement of the movable member in a direction to activate said detection switch.

6. A printing apparatus according to claim 1, wherein said judgment means executes an operation in which said carriage is moved in a direction away from a switch activated area on said movement path by a predetermined distance necessary to take said carriage out of said area when said detection signal is outputted at the beginning of said origin setting operation, and wherein said origin setting control means continues said origin setting operation if said detection signal is not outputted as a result of said operation by said judgment means.

7. A printing apparatus according to claim 5, wherein said movement translating mechanism comprises a cam surface which converts linear motion of said carriage into rotational motion of said movable member.

8. A printing apparatus according to claim 4, wherein said movable member pivots about an axis parallel to said platen and is spring biased to a position away from contact with said detection switch.

9. A printing apparatus according to claim 8, wherein said detection switch comprises a pair of spring contacts.

10. A printing apparatus comprising:

a platen;

a carriage movable on a movement path along said platen;

carriage driving means for driving said carriage;

paper feed means for feeding a printing sheet by the rotation of said platen;

a paper bail unit movable between a pressed position being abutted on said platen and a released position being released from said platen;

a detection switch for outputting a detection signal, said detection switch outputting said detection signal in response to an occurrence of a first condition in which said carriage reaches a certain position on said movement path and in response to an occurrence of a second condition in which said paper bail unit is moved to said released position;

origin setting control means for locating said carriage at an origin position of said carriage on said movement path based on said detection signal;

judgment means for judging to which of said first condition and said second condition said detection signal was responsive;

alarm means for indicating an erroneous condition when it is judged by said judgment means that said detection signal is outputted responsive to said second condition while said origin setting operation is being executed; and paper feed control means for controlling said paper feed means to feed said printing paper by a predetermined stroke when it is judged by said judgment means that said detection signal is outputted responsive to said second condition while said origin setting operation is not being executed.

* * * * *